United States Patent [19]

Keathley et al.

[11] 4,391,114

[45] Jul. 5, 1983

[54] SHEAR FORMING APPARATUS FOR ELONGATED NON-ROTATING METAL TUBES

[75] Inventors: Anthony C. Keathley, Xenia, Ohio; Howard F. Stanton, Lockport; Mahesh M. Wagle, Amherst, both of N.Y.

[73] Assignee: Tubing Technology, Inc., Alpha, Ohio

[21] Appl. No.: 266,708

[22] Filed: May 26, 1981

[51] Int. Cl.[3] ..... B21B 19/12

[52] U.S. Cl. ..... 72/78; 72/121; 72/422

[58] Field of Search ..... 72/78, 121, 290, 422, 72/424

[56] References Cited

U.S. PATENT DOCUMENTS

| | | | |
|---|---|---|---|
| 1,368,413 | 2/1921 | Stiefel | 72/78 |
| 1,596,751 | 7/1926 | Millspaugh | 72/78 |
| 3,404,896 | 10/1968 | Stace et al. | 279/2 |
| 3,431,764 | 3/1969 | Kennedy et al. | 72/78 |
| 4,331,015 | 5/1982 | Benteler et al. | 72/150 |

FOREIGN PATENT DOCUMENTS

| | | | |
|---|---|---|---|
| 2732260 | 1/1979 | Fed. Rep. of Germany | 72/78 |
| 42-6655 | 3/1967 | Japan | 72/78 |
| 599180 | 3/1948 | United Kingdom | 72/290 |

*Primary Examiner*—Lowell A. Larson
*Attorney, Agent, or Firm*—Jacox & Meckstroth

[57] ABSTRACT

A supply of elongated metal tubes are successively transferred laterally to and from a reducing position aligned with the axis of a hollow spindle, and one end of each tube is clamped by a gripper mechanism mounted on a carriage supported between two vertically spaced horizontal lead screws. Each tube is fed by the carriage onto a non-rotatable mandrel located within a non-rotatable guide tube supported within the spindle. The mandrel is supported by a mandrel rod and a centering cone movable axially on the rod within the guide tube, and the mandrel is positioned within a zone where a set of shear forming wheels are orbited around the metal tube by an annular forming head supported by the spindle. While the head is rotating, the orbiting forming wheels are movable radially in response to movement of an eccentric cam mechanism operated by an actuating tube carried within the spindle. The actuating tube is connected by a thrust bearing to a high thrust, non-rotating fluid cylinder which is adjustable for precisely selecting the orbital path of the forming wheels before the metal tube is pulled through the wheels by the carriage. Power actuated motors are connected to the mandrel support rod for retracting the mandrel and for adjusting the mandrel relative to the orbiting wheels.

28 Claims, 10 Drawing Figures

DR
130
18
128
127
126
125
145
132
136
143
W
52
55
25
21
17
15
88
86
84
109
168
172
174
176
178
142
138
148
134
131
4

SHEAR FORMING APPARATUS FOR ELONGATED NON-ROTATING METAL TUBES

BACKGROUND OF THE INVENTION

U.S. Pat. Nos. 1,368,413 and 1,596,751 disclose tube rolling machines or shear forming apparatus wherein a metal tube is fed through a set of shear forming rollers which are orbited around the tube for reducing the outside diameter of the tube by either reducing the wall thickness of the tube and/or by also reducing the inside diameter of the tube. The metal tube may be fed through the orbiting shear forming wheels by locating the axis of each wheel askewed relative to the axis of the tube, for example, as disclosed in above-mentioned U.S. Pat. No. 1,368,413. The tube may also be fed through the wheels by pulling the tube with a carriage mounted for movement along an elongated track. In one machine, the carriage was moved along the track by a lead screw in a manner similar to the movement of a carriage along the bed of a metal cutting lathe.

In shear forming apparatus of the general type described above, it is desirable to provide means for moving the shear forming wheels in corresponding radial directions while the wheels are orbiting around the tube in order to reduce the outside diameter of the metal tube. The inside diameter of the tube may be predetermined by selecting the diameter of a mandrel which is located within the tube in the zone of the orbiting forming wheels, for example, as disclosed above-mentioned U.S. Pat. No. 1,368,413. The inner limits of radial movement of the forming wheels may be selected by providing each wheel holder with a screw which may be adjusted when the wheel support head is stopped. However, it is highly desirable to provide means by which the inner limits of radial movement of the forming wheels may be simultaneously and precisely adjusted while the wheel support head is rotating so that the finished outside diameter of the metal tube may be quickly and precisely selected without stopping the head and thereby provide the shear forming apparatus with a high efficiency in the production of tubes with reduced precision diameters.

SUMMARY OF THE INVENTION

The present invention is directed to an improved shear forming machine or apparatus which quickly and efficiently produces metal tubes with precision inside and outside diameters and with high surface finishes. The apparatus of the invention is also adapted to accommodate a wide range of metals including titanium, stainless steel and special alloy steels for economically producing, for example, fluid cylinders, bearing races, and aircraft and nuclear tubing. The shear forming apparatus of the invention also provides the desirable features mentioned above including means for precisely and simultaneously adjusting the inner limits of radial movement of the shear forming wheels while the wheels are orbiting around a metal tube or workpiece. The apparatus of the invention is also capable of exerting a substantial radially inward force on the shear forming wheels, for example, over fifty tons, so that tubes of relatively exotic metals may be shear-formed to precision diameters and surface finish. The apparatus further provides for efficiently loading and unloading a supply of metal tubes in a successive manner and for accommodating metal tubes within a wide range of diameters.

In accordance with one embodiment of the invention, a shear forming apparatus includes an elongated hollow spindle which supports a head for rotation on a horizontal axis. The head encloses an eccentric lever actuated cam mechanism for supporting and moving a set of shear-forming wheels in corresponding radial paths between outer retracted positions and inner shear-forming positions spaced around a stub mandrel projecting into a metal tube being shear-formed. The cam mechanism is actuated in response to axial movement of an actuating tube carried within the spindle and connected by a thrust bearing to a non-rotating piston tube extending through a high pressure fluid cylinder. A non-rotating annular piston threadably engages the piston tube and may be precisely adjusted relative to the piston tube while the spindle is rotating for precisely selecting the inner limits of movement of the shear-forming wheels orbiting around the tubular workpiece or metal tube.

A non-rotating workpiece guide tube extends through the rotating spindle and the actuating tube and supports an axially sliding cone member which wedges into the end of a tubular workpiece. The cone member also slides on a non-rotating center tie rod which positions the mandrel within the workpiece.

Metal tubes or tubular workpieces to be reduced by shear-forming are successively transferred by a set of loading cylinders to the center axis of the apparatus where one end portion of each tube is gripped by a carriage supported by a pair of vertically spaced horizontal lead screws which are simultaneously driven. The carriage feeds each metal tube into the spindle and guide tube and onto the stub mandrel. The orbiting shear forming wheels are then shifted radially inwardly into the metal tube which is then pulled by the carriage through the orbiting wheels to reduce the tube to a precision outside diameter and surface finish. The reduced diameter finished tube is then unloaded from the carriage by another set of unloading cylinders, and the shear-forming operation is repeated. The apparatus of the invention also incorporates fluid actuated motors for retracting the mandrel and support rod and also for selectively positioning the mandrel axially within the zone of the orbiting shear-forming wheels.

Other features and advantages of the invention will be apparent from the following description, the accompanying drawings and the appended claims.

DESCRIPTION OF THE PREFERRED EMBODIMENT

Figures 1, 2, 3, 4:
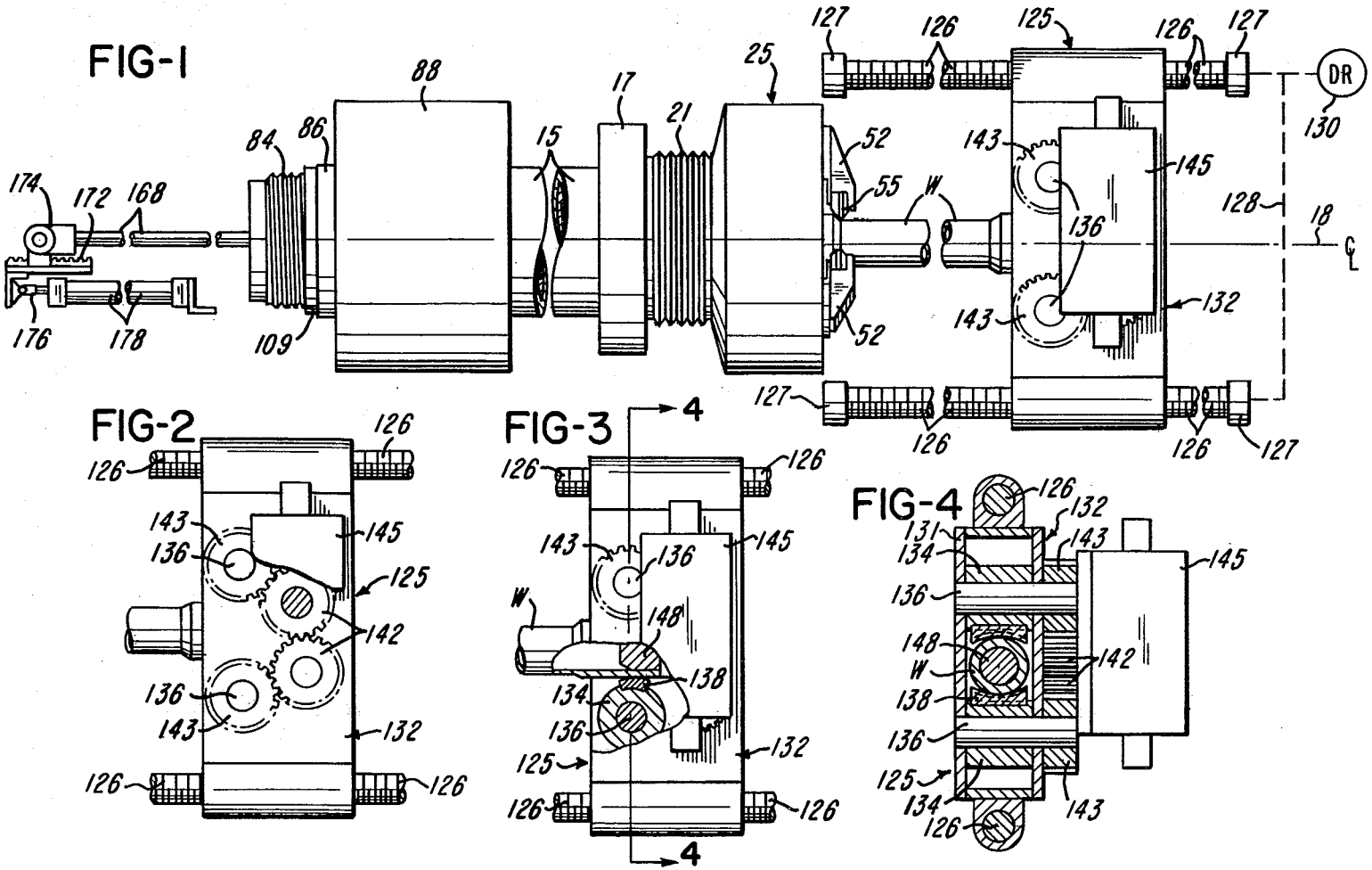
FIG. 1 is a somewhat diagrammatic elevational view of shear-forming apparatus constructed in accordance with the invention.
FIG. 2 is a fragmentary section of the workpiece gripping and transfer carriage shown in FIG. 1 and with a portion broken away.
FIG. 3 is a fragmentary section similar to FIG. 2 and showing the gripping of a tubular workpiece by the carriage mechanism.
FIG. 4 is a fragmentary section of the carriage taken generally on the line 4—4 of FIG. 3.

A shear forming apparatus is illustrated somewhat diagrammatically in FIG. 1 and generally includes an elongated hollow spindle 15 which is supported by a set of axially spaced anti-friction bearings 16 and 17 (FIG. 5) for rotation on a horizontal axis 18. The spindle 15 includes an integrally formed multiple "V" sheave 21 which receives a corresponding multiple "V" drive belt 22 extending from a variable speed electric drive motor (not shown). Preferrably, the drive motor has a relative large output, for example, on the order of 200 horsepower. The spindle 15 also includes an outwardly projecting flange 24 which supports and forms part of a rotor or spindle head 25. The head 25 incorporates a set of interfitting annular sections 27 and 28 which define a cylindrical bore or chamber 29 and a set of three radially extending slots 31.

A jaw member 32 is supported within each of the slots 31 for radial sliding movement, and each jaw member 32 has a cylindrical socket which receives a corresponding cylindrical cam member 34. Each cam member 34 has a pair of outwardly projecting eccentric journals 36 which are supported for rotation by the head section 28, and each cam member 34 has a slot for slidably receiving a lever 38. Each of the three levers 38 is pivotably supported by a cross-pin 39 which is secured to an annular actuating hub member 41 supported for axial movement within the chamber 29. Each of the jaw members 32 has a sloping cam surface 43 which mates with a corresponding tapered surface 44 on the actuating member 41, and a compression spring 46 urges the surface 43 against a wear pad 47 recessed within the surface 44.

Figures 5, 6, 7:
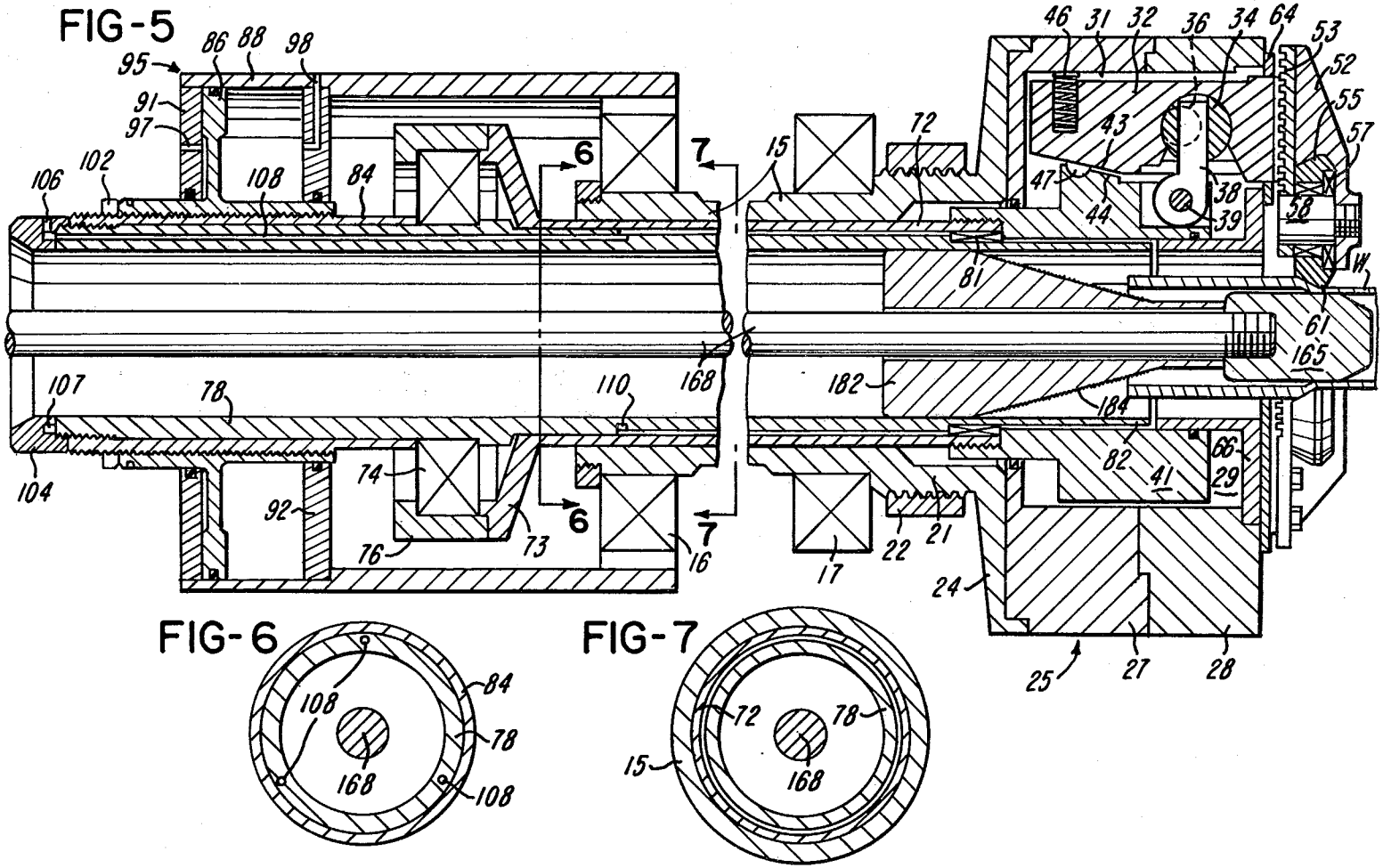
FIG. 5 is an enlarged axial section of the spindle section of the apparatus shown in FIG. 1 and with a center portion broken away.
FIG. 6 is a radial section taken generally along the line 6—6 of FIG. 5.
FIG. 7 is a radial section taken generally along the line 7—7 of FIG. 5.
Figure 9:
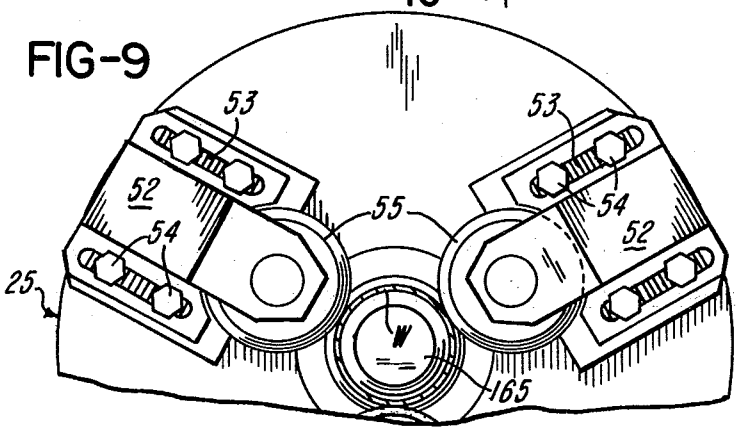
FIG. 9 is a fragmentary enlarged elevational view of the spindle head shown in FIGS. 1, 5 and 8.

Each of the three jaw members 32 supports a wheel holder 52 which is adjustably coupled to the jaw member by mating interfitting teeth 53 and a set of machine screws 54 (FIG. 9). When the screws 54 are released, each wheel holder 52 may be adjustably positioned in a relative coarse incremental manner on its corresponding support jaw member 36. As best shown in FIG. 5, a shear-forming roller or wheel 55 is carried by each wheel holder 52, and each forming wheel 55 is supported by a set of anti-friction bearings 57 mounted on a corresponding stub shaft 58. The outer peripheral surface of each forming wheel 55 is generally V-shaped in cross-section and forms a slightly rounded outer peripheral surface 61. The three jaw members 36 project through corresponding slots formed within an annular flat sealing pad 64 which seats on the head section 28 and also on the end face of an annular closure member 66 which cooperates with the head section 28 to define the chamber 29.

The general construction, support and operation of the mechanism within the spindle head 25 is disclosed in U.S. Pat. No. 3,404,896, and the mechanism is commonly used for supporting a set of angularly arranged lathe-type gripping jaws. When the actuating member 41 is shifted or moved to the left (FIG. 5), the jaw members 36, wheel holders 52 and shear forming wheels 55 are simultaneously shifted inwardly. As a result of the high mechanical advantage of the eccentric cam actuation, the inward radial force exerted by the jaw members 36 and transferred to the shear forming wheels 55 is very substantial. For example, the total inward radial force may exceed 150,000 pounds of which 50,000 pounds may be used to overcome centrifugal force and friction acting on the spindle head 25 when the head is rotated at a relatively high speed, for example, 2500 R.P.M. In such high speed operation, the balance of the available inward radial force exerted by the wheels on a metal tube or a tubular metal workpiece W (FIG. 5) is on the order of 100,000 pounds or 50 tons.

The actuating hub member 41 which rotates with the spindle head 25, is threadably coupled to the forward end portion of an actuating member or tube 72 which is supported for axial sliding movement within the spindle 15 while the tube 72 rotates with the spindle. The rearward or left end portion of the actuating tube 72 has an outwardly projecting flange portion 73 which is secured to the outer race of an anti-friction thrust bearing 74 by a retaining ring 76. The inner race of the bearing 74 is mounted on a non-rotating workpiece guide tube 78 which extends forwardly through the spindle 15 and actuating tube 72. An antifriction needle bearing 81 is retained by the forward end portion of the actuating tube 72 and supports a reduced cylindrical forward end portion 82 of the guide tube 78.

The inner race of the bearing 74 is secured to the guide tube 78 by a surrounding piston tube 84 which has external threads for receiving a nonrotating piston 86 slidably supported within a surrounding cylinder 88. The cylinder 88 receives a set of annular cylinder walls 91 and 92 to form a double-acting fluid or pneumatic cylinder 95.

Pressurized fluid or air is alternately supplied to opposite sides of the piston 86 through passages 97 and 98 within the cylinder walls 91 and 92, respectively. A lock ring or nut 102 is threaded onto the outer end portion of the piston tube 84 and locks the piston 86 onto the piston tube 84 after the piston 86 is axially adjusted on the piston tube 84, as will be explained later.

A closure ring 104 (FIG. 5) is secured to the outer or left end portion of the guide tube 78 and has a radial port 106 connecting with an annular groove 107 which, in turn, connects with a set of three axially extending passages 108 (FIG. 6) formed within the guide tube 78. A pressurized air and oil mist is supplied through the port 106 and passages 108 to a peripheral groove 110 in the guide tube 78 where the mist flows axially in opposite directions between the rotating actuating tube 72 and the non-rotating guide tube 78. The mist lubricates the needle bearing 81 and the bearing 74 and flows through an annular clearance of a few thousandths between the concentric tubes 72 and 78. As shown in FIG. 5, the cylinder 88 encloses the bearings 16 and 74, and a supply of lubricating air/oil mist is continuously supplied to these bearings as well as to the housing portion (not shown) which retains the forward spindle support bearing 17.

Figure 8:
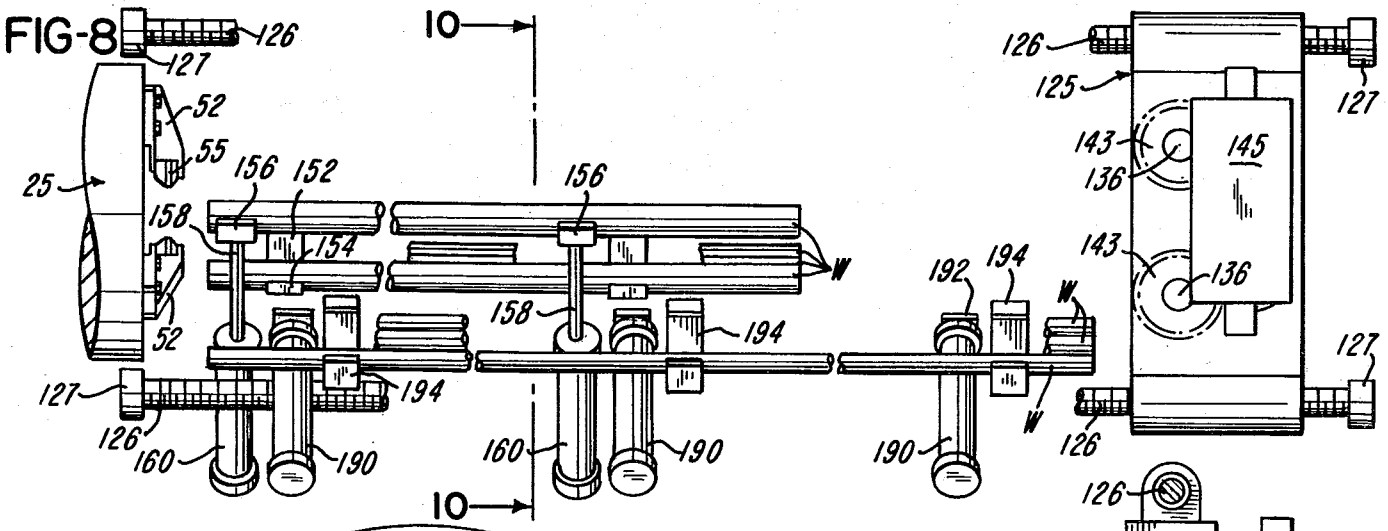
FIG. 8 is a somewhat diagrammatic elevational view of the carriage and the workpiece loading and unloading mechanism for the apparatus shown in FIG. 1.

Referring to FIGS. 1 and 8, a carriage 125 is supported by a pair of vertically spaced elongated lead screws 126 which are rotatably supported by corresponding anti-friction thrust bearings 127 and are simultaneously driven through a timing belt 128 and a reversible variable speed servo-controlled DC motor 130. The carriage 125 includes a housing 131 (FIG. 4) which forms part of a gripping mechanism 132 including a pair of rotary gripping hubs 134 mounted on parallel spaced shafts 136. Each of the hubs 134 carries an outwardly projecting eccentric wedge shoe 138 (FIGS. 3 and 4), and the shafts 136 are simultaneously rotated through a set of transfer gears 142 and 143 connected to a rack and pinion type of fluid actuator 145 mounted on the carriage 125.

As shown in FIGS. 3 and 4, an end portion of each tubular workpiece W is received between the gripper hubs 134 after which the fluid motor 145 is actuated so that the eccentric wedge shoes 138 firmly engage the end portion of the workpiece W by a wedging action whereby the greater the pulling force on the tubular workpiece W, the greater the wedging or gripping force. Preferably, the end portion of each tubular workpiece receives a core plug 148 (FIG. 3) which cooperates with the wedge shoes 138 and prevents collapsing of the end portion by the shoes 138.

Figure 10:
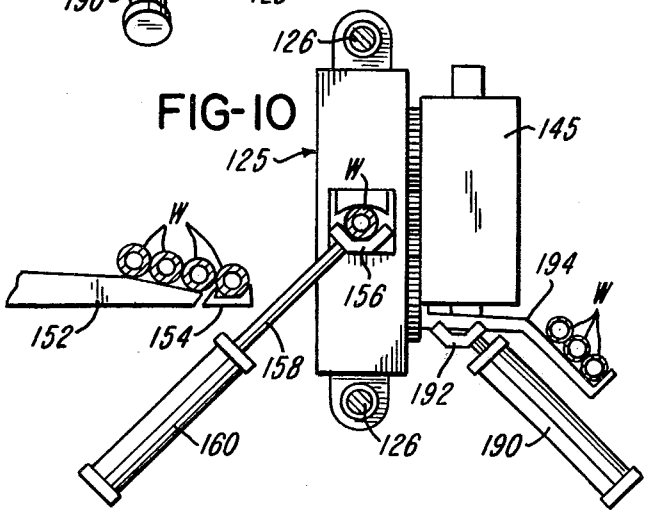
FIG. 10 is a somewhat diagrammatic vertical section of the workpiece loading and unloading mechanism and the carriage, as taken generally along the line 10—10 of FIG. 8.

Referring to FIGS. 8 and 10, a supply of steel tubes or tubular workpieces W to be shear-formed on the apparatus of the invention, is supported by a set of inclined ramp members 152. Each tubular workpiece W is transferred by escapement-type pivotal transfer members 154 to a set of V-shaped support shoes 156 mounted on piston rods 158 extending from a corresponding set of fluid actuated loading cylinders 160. When the piston rods 158 are retracted, the shoes 156 receive a workpiece W to be shear-formed from the transfer members 154. When the piston rods 158 are extended, the shoes 156 position each workpiece W in alignment with the axis 18 of the spindle 15 which is also in alignment with the gripping mechanism 132 on the carriage 125.

After a workpiece W is aligned, the carriage 125 is fed towards the spindle head 25 until the outer end portion of the workpiece is received between the gripping hubs 134. The motor 145 is then actuated to rotate the wedge members 138 into positive gripping engagement with the end portion of the workpiece W. As the carriage 125 continues to feed towards the spindle head 25, the opposite end of the tube or workpiece W feeds onto a stub-type cylindrical mandrel 165 (FIG. 5) which is positioned within the zone of the shear-forming wheels 55 by a non-rotating mandrel support rod 168. The support rod 168 projects through the non-rotating guide tube 78, and the rearward end portion of the rod 168 is adjustably connected to a gear rack 172 by an actuator 174 preferably driven by a reversible electric DC motor.

Operation of the actuator 174 is effective to move the mandrel connecting rod 168 and the mandrel 165 through a predetermined distance, such as six inches, relative to the rack 172. As also shown in FIG. 1, the rack 172 is connected to the piston rod 176 of an elongated fluid cylinder 178. The length of the fluid cylinder 178 and the movement of the piston rod 176 is sufficient to retract the mandrel 165 rearwardly from the guide tube 78 so that the mandrel 167 may be quickly and conveniently replaced. The length of the spindle 15 may be on the order of six feet.

A workpiece support member or cone 182 is slidably supported on the mandrel tie rod 168 and within the guide tube 78 and has a serrated conical surface 184. When a tubular workpiece W is being fed onto the mandrel 165 by the carriage 125, the inner end of the workpiece W engages the serrated conical surface 184, and the support cone wedges into the workpiece W. The support cone 182 then travels or slides on the connecting rod 168 and moves with the workpiece W until the carriage 125 is located adjacent the wheel support holders 52 on the spindle head 25.

After a metal tube or tubular workpiece W is loaded or shifted into the guide tube 78 by the carriage 125 and is ready to be shear-formed, the air cylinder 95 is actuated to shift the piston 86 to the left (FIG. 5), causing the orbiting shear-forming wheels 55 to shift inwardly into the metal to the desired reduced outer diameter of the finished workpiece W. As the wheels 55 are shifted inwardly, the carriage 125 is moved away from the rotating spindle head 25 by reversing the drive 130 so that the workpiece is pulled through the orbiting wheels 55 and over the internal mandrel 165, as illustrated in FIG. 5. The outward movement of the carriage 125 continues until the inner end of the tubular workpiece W passes through the orbiting wheels 55 and the workpiece is reduced to a uniform outer diameter. As the workpiece is pulled by the carriage, the support cone 182 travels with the workpiece so that the cone 182 continues to keep the mandrel 165 centered after the workpiece is pulled completely through the wheels.

Before the workpiece is pulled by the carriage 125 completely through the orbiting wheels 55, a set of fluid or air unloading cylinders 190 (FIG. 10) are actuated to extend a corresponding set of support shoes 192 to a position where the tubular workpiece being pulled by the carriage 125 is supported by the shoes 192. After the tubular workpiece W is pulled completely through the orbiting wheels 55, the gripping mechanism of the carriage 125 is released, and the carriage 125 continues to move along the lead screws 126 out of engagement with the finished shear-formed workpiece supported by the shoes 192. Cylinders 190 are then actuated to retract the shoes 192 until the finished workpiece engages a set of ramps 194 which deliver the finished workpiece to a removal or unloading station as shown in FIG. 10.

From the drawings and the above description, it is apparent that a shear-forming machine or apparatus constructed in accordance with the invention, provides desirable features and advantages. As one important feature, the apparatus provides for shear-forming a tubular workpiece with a substantial inwardly radial force exerted by the shear-forming wheels 55 so that a wide range of metals may be shear-formed by the apparatus. The non-rotating piston 86 also has a relative large diameter so that a substantial axial force may be exerted on the actuating tube 72 and the actuating member 41 to obtain the substantial inward pressure or force exerted by the forming wheels 55. It is also apparent that while the spindle head 25 is rotating, the axial position of the piston 86 on the piston tube 84 may be precisely adjusted after releasing the lock nut 102 so that the inner limits of movement of the forming wheels 55 may be precisely selected to obtain an outer diameter within a small tolerance. For example, the wheels 55 may be adjusted to form a diameter within plus or minus 0.001 inch on a tubular workpiece having a diameter of 4.5 inch. The spindle 15 and spindle head 25 are also constructed and supported for high speed rotation without vibration, for example, up to 2500 rpm, in order to obtain a high precision surface finish on the shear-formed tubular workpiece.

Another important feature is provided by the support of the mandrel 165 by the tie rod 168 by the slidable support cone 182 within the non-rotatable guide tube 178. That is, the slidable workpiece support member of cone 182 maintains the mandrel 165 centered within the spindle head 125 after a workpiece has been pulled through the orbiting forming wheels 55 and while each unfinished workpiece is being fed by the carriage 125 into the guide tube 78 while the spindle 15 and spindle head 25 continue to rotate. The serrated surface 184 on the support cone 182 is also effective to wedge into the inner end of the tubular workpiece W so that the support cone 182 is carried with the workpiece as it is being pulled through the orbiting wheels 55 and until the support cone 182 engages and is stopped by the mandrel 165.

As mentioned above, the electric motor actuator 174 provides for precisely adjusting the mandrel 165 axially relative to the orbiting forming wheels 55 so that the mandrel 165 does not receive concentrated wear and the inside diameter of the shear-formed tubular workpiece may be precisely maintained while processing a substantial number of workpieces. When it is desirable to replace or repair the mandrel 165, the fluid cylinder 178 is actuated to retract the mandrel support rod 168 and mandrel 165 from the rearward end of the guide tube 78 formed by the closure ring 104.

The arrangement of the vertically spaced lead screws 126 above and below the center axis 18 of the spindle 15, cooperates with the carriage 125 and workpiece gripping mechanism 132 to provide for pulling each workpiece with a substantial force which is evenly balanced on the lead screws 126. The vertical arrangement of the lead screws 126 also provides for conveniently loading and unloading each tubular workpiece W laterally with respect to the centerline 18 and the carriage 125 in order to obtain maximum efficiency of operation of the shear forming apparatus as well as provide for substantially automatic operation of the apparatus without stopping the rotation of the spindle.

While the shear-forming apparatus herein described and its method of operation constitute a preferred embodiment of the invention, it is to be understood that the invention is not limited to the precise form of apparatus and method described, and that changes may be made therein without departing from the scope and spirit of the invention as defined in the appended claims.

The invention having thus been described, the following is claimed:

1. Shear forming apparatus for reducing the diameter of an elongated cylindrical workpiece, comprising a tubular spindle supporting an annular forming head for rotation on an axis, a plurality of angularly disposed forming wheels supported by said head for orbital movement around the axis, an actuating tube disposed within said spindle for rotation therewith and supported for axial movement within said spindle, actuating means within said head and connected to said actuating tube, said actuating means being effective to move said forming wheels in corresponding generally radial directions in response to axial movement of said actuating tube within said spindle, means for pulling the workpiece axially through said spindle and said head and between said forming wheels, a fluid cylinder having a non-rotating piston, means including a non-rotating connecting tube and a thrust bearing for connecting said piston to said actuating tube for moving said actuating tube axially while said spindle and head are rotating to effect radial inward deformation of the workpiece by said forming wheels, and means for precisely adjusting a limit of movement of said connecting tube to control the limit of generally radial inward movement of said forming wheels.

2. Shear forming apparatus as defined in claim 1 wherein said actuating means within said forming head comprise a plurality of circumferentially spaced jaw members, a corresponding plurality of wheel holders rigidly connected to said jaw members and supporting the corresponding said forming wheels, and rotatably eccentric cam means connecting said jaw members to said actuating tube.

3. Shear forming apparatus as defined in claim 2 wherein said rotatably eccentric cam means comprise a cylindrical member rotably supported within each jaw member, shaft means supporting each said cylindrical member for rotation on an eccentric axis, and a lever supported by each said cylindrical member and pivotally connected to said actuating tube.

4. Shear forming apparatus as defined in claim 1 and including a non-rotatable workpiece guide tube supported within said actuating tube by bearing means.

5. Shear forming apparatus as defined in claim 4 wherein said non-rotating guide tube includes means defining at least one longitudinally extending passage for directing a lubricating fluid.

6. Shear forming apparatus as defined in claim 4 and including a mandrel adapted to be positioned within the workpiece in the region of said forming wheels, an elongated mandrel rod extending axially within said guide tube and having an inner end portion connected to said mandrel, and means for moving said mandrel rod axially.

7. Shear forming apparatus as defined in claim 1 wherein said fluid cylinder includes a non-rotating piston tube having external threads receiving said piston.

8. Shear forming apparatus as defined in claim 1 and including a mandrel adapted to receive the workpiece, an elongated mandrel rod extending through said spindle and having an inner end portion supporting said mandrel within said forming wheels, and first power operated means connected to an outer end portion of said mandrel rod for moving said mandrel between an operating position within the region of said forming wheels and a retracted position with said mandrel removed from said spindle.

9. Shear forming apparatus as defined in claim 8 and including second power operated means for moving said mandrel rod within predetermined limits relative to said first power operated means for precisely positioning said mandrel relative to said forming wheels.

10. Shear forming apparatus as defined in claim 1 wherein said means between the screws for pulling the workpiece between said forming wheels, comprise a set of parallel spaced elongated lead screws extending axially from said forming head and supported for rotation on corresponding parallel spaced axes, a carriage mounted on said lead screws and having means for gripping the leading end portion of the workpiece, and means for simultaneously driving said lead screws to produce axial movement of said carriage relative to said forming wheels.

11. Shear forming apparatus as defined in claim 10 wherein the axes of said lead screws define a plane generally including the axis of said spindle, and the axis of said spindle is disposed between the axes of said lead screws.

12. Shear forming apparatus as defined in claim 11 wherein the plane defined by the axes of said lead screws is generally vertical with said lead screws located above and below the axis of said spindle.

13. Shear forming apparatus as defined in claim 10 wherein said workpiece gripping means on said carriage comprise a pair of gripping wedge members supported between said lead screws for rotation on corresponding parallel spaced axes, and reversible power actuating means for rotating said gripping wedge members to effect gripping and releasing of a leading end portion of the workpiece.

14. Shear forming apparatus as defined in claim 10 and including means for successively transferring a supply of workpieces laterally between said vertically spaced lead screws and for positioning each workpiece with its axis aligned with the axis of said spindle to provide for using said carriage for loading each workpiece into said spindle when said forming wheels are retracted on said forming head in addition to using said carriage for pulling each workpiece between said forming wheels when said wheels are orbiting around the workpiece and deforming the workpiece.

15. Shear forming apparatus as defined in claim 14 wherein said means for successively transferring a supply of workpieces, comprise a plurality of axially spaced workpiece loading supports, and power actuated means for moving said loading supports between a workpiece receiving position and a loading position to locate each workpiece substantially on the axis of said spindle.

16. Shear forming apparatus as defined in claim 15 wherein said workpiece transferring means further comprise a plurality of axially spaced workpiece unloading supports, and power actuated means for moving said unloading supports between an extended position for receiving each formed workpiece from said carriage and a retracted position for unloading each formed workpiece.

17. Shear forming apparatus as defined in claim 16 wherein said power actuated means for moving said loading and unloading supports comprise corresponding sets of fluid cylinders disposed on opposite sides of said lead screws.

18. Shear forming apparatus as defined in claim 1 and including a mandrel adapted to be positioned within the workpiece in the region of said forming wheels, an elongated non-rotating workpiece guide tube disposed within said actuating tube, an elongated mandrel rod extending axially within said guide tube and having an inner end portion connected to said mandrel, and means for moving an outer end portion of said mandrel rod for moving said mandrel axially relative to said forming wheels.

19. Shear forming apparatus as defined in claim 18 and including a mandrel support member supported for axial movement on said mandrel rod and within said guide tube, and said mandrel support member having means for engaging the workpiece for axial movement therewith.

20. Shear forming apparatus as defined in claim 19 wherein said workpiece engaging means on said mandrel support member comprise a generally conical surface adapted to wedge into a tubular workpiece.

21. Shear forming apparatus for reducing the diameter of an elongated cylindrical workpiece, comprising a tubular spindle supporting an annular forming head for rotation on an axis, a plurality of angularly disposed forming wheels supported by said head for orbital movement around the axis, an actuating tube disposed within said spindle for rotation therewith and supported for relative axial movement, actuating means within said head and connected to said actuating tube, said actuating means being effective to move said forming wheels in corresponding generally radial directions in response to axial movement of said actuating tube within said spindle, means for pulling the workpiece axially through said spindle and head and between said forming wheels, a fluid cylinder having a non-rotating piston, means connecting said piston to said actuating tube for moving said actuating tube axially to effect radial inward deformation of the workpiece by said forming wheels, an elongated non-rotating workpiece guide tube disposed within said actuating tube, and bearing means supporting said non-rotating guide tube within said actuating tube.

22. Shear forming apparatus as defined in claim 21 and including a mandrel adapted to be positioned within the workpiece in the region of said forming wheels, an elongated mandrel rod extending axially within said guide tube and having an inner end portion connected to said mandrel, and means supported by said guide tube for axial movement and adapted to engage the inner end portion of each workpiece to position the workpiece on the axis of said spindle.

23. Shear forming apparatus for reducing the diameter of an elongated cylindrical workpiece, comprising a tubular spindle supporting an annular forming head for rotation on an axis, a plurality of angularly disposed forming wheels supported by said head for orbital movement around the axis, an actuating tube disposed within said spindle for rotation therewith and for relative axial movement, actuating means within said head and connected to said actuating tube, said actuating means being effective to move said forming wheels in corresponding generally radial directions in response to axial movement of said actuating tube within said spindle, means for pulling the workpiece axially through said spindle and head and between said forming wheels, a fluid cylinder having a non-rotating piston, means connecting said piston to said actuating tube for moving said actuating tube axially while said spindle and head are rotating to effect radial inward deformation of the workpiece by said forming wheels, said pulling means including a set of parallel spaced elongated lead screws extending axially from said forming head and supported on corresponding parallel spaced axes with the axis of said spindle therebetween, a carriage mounted on said lead screws and having means between said lead screws for gripping the leading end portion of the workpiece, and drive means for rotating said lead screws to move said carriage axially along said lead screws.

24. Shear forming apparatus as defined in claim 23 wherein the axes of said lead screws define a generally vertical plane generally including the axis of said spindle.

25. Shear forming apparatus as defined in claim 24 and including means for successively transferring a supply of workpieces laterally between said lead screws and for positioning each workpiece with its axis aligned with the axis of said spindle to provide for using said carriage for loading each workpiece into said spindle when said forming wheels are retracted on said forming head in addition to using said carriage for pulling each workpiece between the orbiting said forming rollers.

26. A method for successively and efficiently shear-forming a supply of elongated cylindrical metal tubes to a precision reduced diameter, comprising the steps of supporting a set of angularly arranged shear-forming wheels with an annular forming head mounted on a horizontal hollow spindle, supporting within said head means for moving the forming wheels generally radially while the wheels are orbiting around the axis of the spindle, supporting within the spindle a non-rotating guide tube, supporting with the guide tube a mandrel located in the region of the forming wheels, gripping one end portion of each metal tube with a gripper on a carriage supported for horizontal movement relative to the forming head, moving the carriage towards the forming head while the forming head is rotating and the wheels are retracted to move the metal tube axially onto the mandrel and into the guide tube, maintaining the metal tube on the axis of the spindle with the guide tube, shifting the forming wheels radially inwardly into the metal tube and towards the mandrel to the predetermined reduced diameter, and moving the carriage away from the forming head for pulling the metal tube from the guide tube through the forming wheels while the wheels are orbiting around the metal tube.

27. A method as defined in claim 26 and including the step of supporting the carriage between vertically spaced elongated lead screws extending horizontally from the forming head with the axis of the spindle between the lead screws.

28. A method as defined in claim 27 and including the step of successively transferring a supply of metal tubes laterally between the lead screws and between the forming wheels and the carriage for loading each metal tube into the carriage before shear-forming and for unloading each metal tube from the carriage after shear-forming.

* * * * *